US005201577A

United States Patent [19]

Suzuki et al.

[11] Patent Number: 5,201,577

[45] Date of Patent: Apr. 13, 1993

[54] SUPPORT STRUCTURE HAVING BUILT-IN LIGHT SOURCE

[75] Inventors: Hirotsugu Suzuki, 514, Nougayamachi, Machida-shi, Tokyo; Michio Terajima, Machida, both of Japan

[73] Assignee: Hirotsuga Suzuki, Tokyo, Japan

[21] Appl. No.: 894,862

[22] Filed: Jun. 8, 1992

Related U.S. Application Data

[63] Continuation of Ser. No. 700,366, May 13, 1991, abandoned.

[30] Foreign Application Priority Data

Jan. 16, 1991 [JP] Japan ..... 2-70233

[51] Int. Cl.[5] ..... F21V 33/00

[52] U.S. Cl. ..... 362/101; 362/97; 362/127; 108/23

[58] Field of Search ..... 362/97, 101, 125–134, 362/805, 806, 311, 410–412; 108/23

[56] References Cited

U.S. PATENT DOCUMENTS

| | | | |
|---|---|---|---|
| 1,279,820 | 9/1918 | Brassard | 362/97 |
| 1,644,289 | 10/1927 | Timpson | 362/97 |
| 1,681,040 | 8/1928 | Kemp | 362/101 |
| 1,788,058 | 1/1931 | Jyumi | 362/122 |
| 2,145,238 | 1/1939 | Falk | 362/133 |
| 2,177,337 | 10/1939 | Stein | 362/101 |
| 2,611,856 | 9/1952 | Fredin | 362/101 |
| 4,330,813 | 5/1982 | Deutsch | 362/97 |
| 4,336,574 | 6/1982 | Goodman | 362/101 |
| 4,344,113 | 8/1982 | Ditto et al. | 362/101 |
| 5,010,461 | 4/1991 | Saotome | 362/101 |

FOREIGN PATENT DOCUMENTS

| | | | |
|---|---|---|---|
| 1096603 | 6/1955 | France | 108/23 |
| 2220737 | 1/1990 | United Kingdom | 362/311 |

*Primary Examiner*—James C. Yeung

*Attorney, Agent, or Firm*—Price, Heneveld, Cooper, DeWitt & Litton

[57] ABSTRACT

A support structure having a built-in light source aimed to project light directly upward onto an object, such as a cocktail glass, from a position directly below it, so as to allow its inherent glittering quality to be shown. The structure includes a recess in the upper portion of a support on which the object is to be placed, a light source at the bottom of the recess, a convex lens at an upper position of the recess, a transparent flat member above the convex lens, a switch at a fixed position in the support, and an electrical wire connecting the switch with the light source.

15 Claims, 3 Drawing Sheets

SUPPORT STRUCTURE HAVING BUILT-IN LIGHT SOURCE

This is a continuation of application Ser. No. 07/700,366, filed May 13, 1911, abandoned.

BACKGROUND OF THE INVENTION

1. Field of the Invention

The present invention relates to a support structure for an object that has a built-in light source.

2. Description of the Related Art

Hitherto, certain objects have been illuminated with light cast from above or oblique to the object, so as to show them to be beautiful, and then to produce some stage effect. In this lighting, light is projected not only onto the object itself but also on the periphery thereof so that the object and the periphery, in combination or as a whole, define an area having the object as the center of attention and offering a beautiful atmosphere, which thus serves the purpose.

However, projecting light from above or obliquely in order to show the object to be beautiful can be disadvantageous because of the illumination of not only the object itself but also the periphery. That is, it has been impossible to show the inherent glittering quality of objects themselves.

This is particularly true when light is projected downward or obliquely onto an object such as a cocktail glass filled with a cocktail and placed on a bar counter, or a jewel placed on a display surface. Because the light cast downward or obliquely onto the glass or jewel is diffused, the inherent glittering quality of the object cannot be shown.

SUMMARY OF THE INVENTION

An object of the present invention is to provide a support structure having a light source at a position directly below an object, such as a cocktail glass or jewel, placed on a support, so that light is projected directly upward onto the object without being diffused into the periphery. The projected light is concentrated on the object such as a cocktail glass or jewel, thereby making it possible to show the inherent glittering quality of the jewel or the glass and the cocktail contained therein.

In order to achieve this object, according to the present invention, a switch is provided at a fixed position in a support for an object; a recess is formed in the upper portion of the support on which the object is to be placed; a light source is provided at the bottom of the recess; electrical wires are provided to connect the switch with the light source; a convex lens is provided at an upper position of the recess; and a transparent flat member is disposed above the convex lens at the same height as the upper surface of the support.

The effect achieved is even better if the support is a bar counter or table; the convex lens has a diameter of 1.6 cm; the light source is a miniature bulb; and/or the transparent flat member is a sheet of glass.

When an object such as a jewel or a cocktail glass containing a cocktail is placed on the support, and light is projected directly upward from below, the convex lens prevents the light from diffusing, allowing the light to be cast only onto the jewel or the glass and the cocktail, thereby showing the inherent glittering quality and beauty of the object.

In order to achieve even better effects, the convex lens should have a diameter of 1.6 cm because lenses of a greater diameter fail to concentrate the light; and miniature bulbs should be used as the light source. The use of a bar counter or a table also assures a better effect.

DESCRIPTION OF THE PREFERRED EMBODIMENT

An embodiment of the present invention will now be described with reference to the drawings. In the illustrated embodiment, the support structure has a support 4 for objects which consists of a bar counter. However, the support of the support structure according to the present invention may be any support for an object or objects, and a table for supporting jewels or tableware is a suitable example. The object or objects to be placed on the support may be any light-transmitting object(s), and suitable examples include, not only cocktail glasses and jewels, but also decorative objects made of glass and glasses for containing juice, etc.

Figure 1:
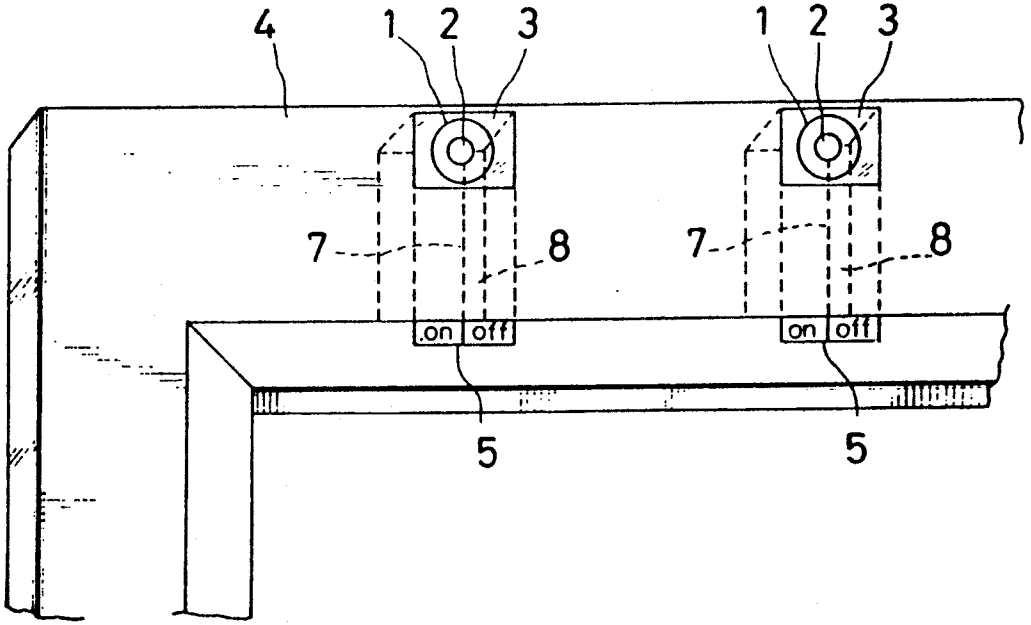
FIG. 1 is a view of a support structure having a built-in light source according to an embodiment of the present invention.
Figure 2:
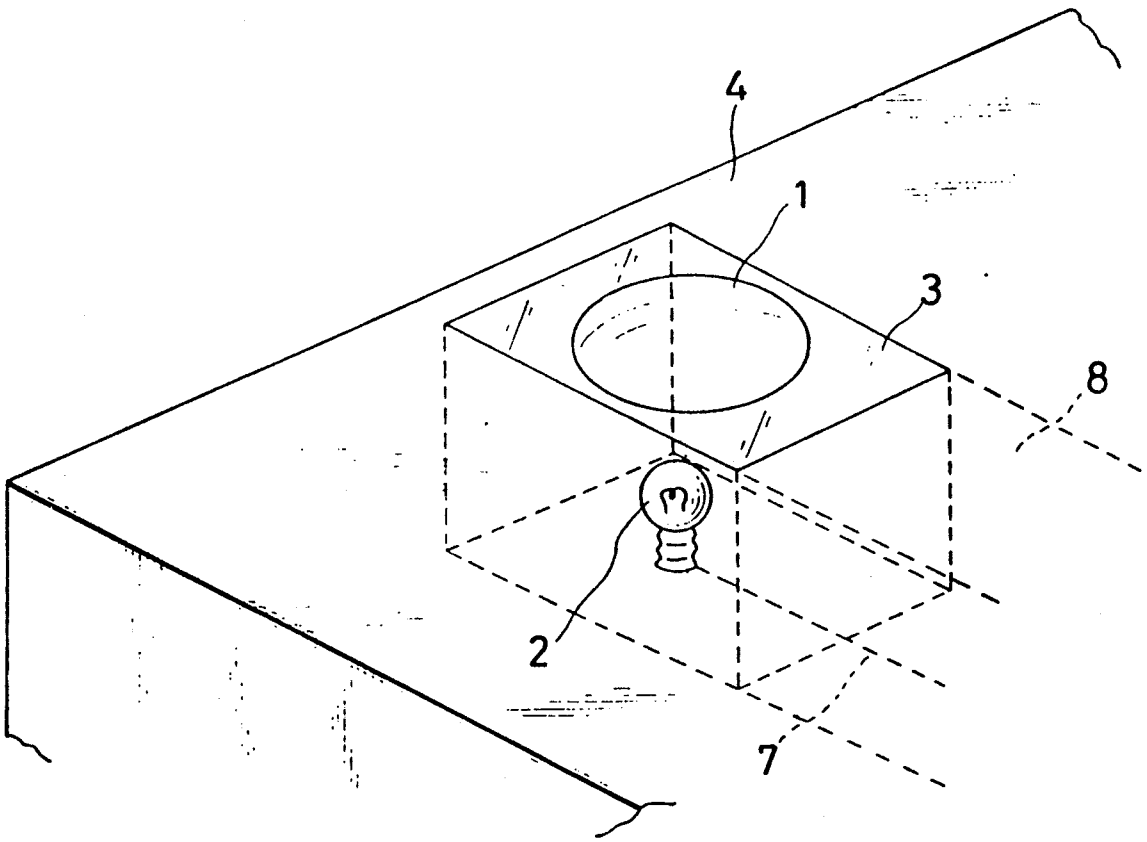
FIG. 2 is an enlarged view of a part of the support structure on which an object is to be placed.
Figure 3:
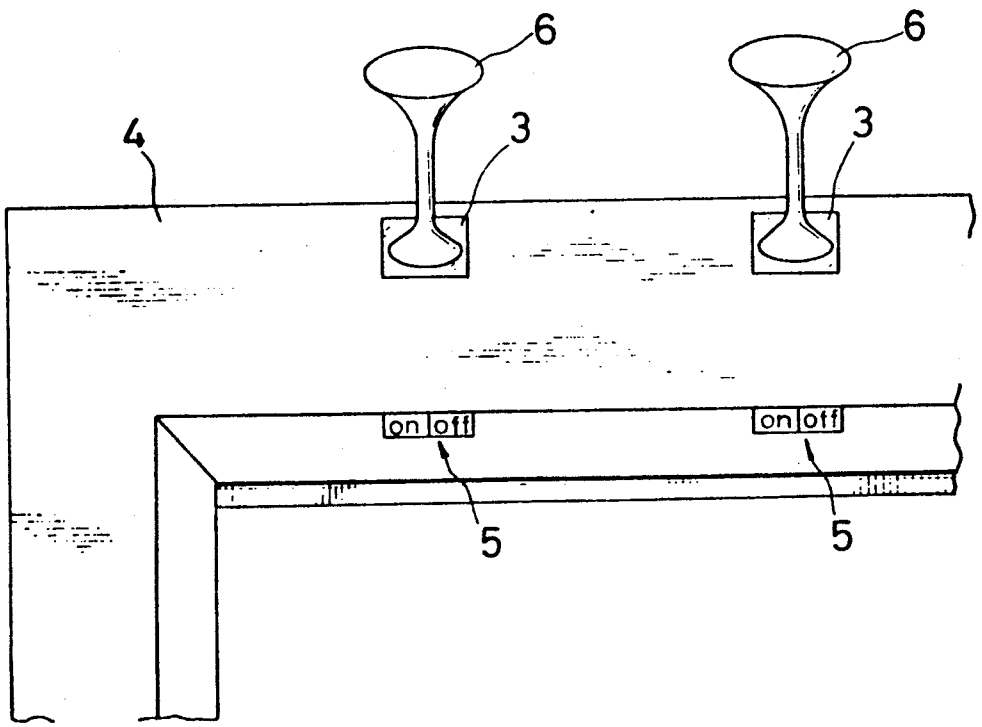
FIG. 3 is a view similar to FIG. 1, also showing objects placed on the support of the support structure.

As shown in FIGS. 1 and 3, switches 5 are provided at fixed positions in the support 4, and are turned on when light is to be projected, and are turned off when not needed. Recesses are provided in the upper portion of the support 4, or the counter, on which the objects, such as cocktail glasses, are to be placed. In the illustrated embodiment, these recesses are on that side of the counter where people may be seated enjoying their drinks, that is, on the opposite side of the switches 5. A miniature bulb 2, serving as the light source, is provided at the bottom of each of the recesses. Each of the switches 5 is connected with the miniature bulb 2 by electrical wires 7, and the wires 7 are passed through cavities 8 in the support 4, as shown in FIGS. 1 and 2. A convex lens 1 is provided at an upper position of each of the recesses. When the support 4 is a bar counter, a proper diameter of the lens 1 is 1.6 cm in order to prevent diffusion of the light projected from the bulb 2. Further, a transparent flat member 3 is disposed above each of the recesses at the same height as the upper surface of the support 4. The transparent flat member 3 is preferably a sheet of glass Objects, such as cocktail glasses 6, are placed on the support 4 as shown in FIG. 3.

By virtue of the above-described construction of the support structure according to the present invention, it is possible to project light directly upward onto an object, such as a cocktail glass or jewel, from a position directly below it, and to concentrate the light only on the object. As a result, if the object is a glass or jewel, it can be more effectively shown to be beautiful by allowing the object to glitter to an extent which has not conventionally been possible Even the foam in a glass of beer will glisten when illuminated in this manner. Thus, light projected upward onto such an object from a position directly below it, concentrated on it, and transmitted through it allows the inherent glittering quality of the object, such as a container and its liquid contents, to be shown.

What is claimed is:

1. A support structure having a built-in light source for illuminating the interior of a light transmissive object positioned above said light source comprising:

a counter for supporting a light transmissive object, said counter having an aperture therein;

a light source positioned to send light upwardly through said aperture in said counter;

a convex lens spaced above said light source and below but adjacent to said counter for concentrating the light from said light source into a focused beam shining upwardly out of said aperture in said counter; and a transparent plate substantially even with said counter covering said aperture in said counter for supporting a light transmissive object to be illuminated by the focused beam of light from said convex lens.

2. A support structure according to claim 1, wherein said support (4) is a bar counter or table.

3. A support structure according to claim 1, wherein said convex lens (1) ha a diameter of 1.6 cm.

4. A support structure according to claim 1, wherein said light source (2) is a miniature bulb.

5. A support structure according to claim 1, wherein said transparent flat member (3) is a sheet of glass.

6. A support structure according to claim 1, wherein said light transmissive object is a glass.

7. A support structure according to claim 2, wherein said light transmissive object is a glass and a liquid contained in the glass.

8. A support structure according to claim 3, wherein said light transmissive object is a cocktail glass and a cocktail contained in said cocktail glass.

9. A support structure according to claim 1, wherein a switch is provided for controlling said light source.

10. A support structure according to claim 1, wherein said light source is positioned in the counter space used by a customer.

11. A support structure according to claim 1, wherein said counter is a table top.

12. A support structure according to claim 1, wherein said convex lens is positioned in close proximity to said transparent plate.

13. A support structure according to claim 12, wherein said convex lens is positioned closer to said transparent plate than to said light source.

14. A support structure according to claim 1, wherein said convex lens is 1.6 cm in diameter and said light source is a miniature light bulb.

15. A support structure according to claim 1, wherein said convex lens is positioned in said aperture in said surface.

* * * * *

UNITED STATES PATENT AND TRADEMARK OFFICE

CERTIFICATE OF CORRECTION

PATENT NO. : 5,201,577
DATED : April 13, 1993
INVENTOR(S) : Hirotsuga Suzuki et al.

It is certified that error appears in the above-indentified patent and that said Letters Patent is hereby corrected as shown below:

column 1, line 6: "May 13, 1911." should be --May 13, 1991.--;

column 2, line 52: after "glass" insert --.--;

column 2, line 63: after "possible" insert --.--;

column 3, line 24: "ha" should be --has--;

column 4, line 3, claim 7: "claim 2" should be --claim 6--;

column 4, line 6, claim 8: "claim 3" should be --claim 7--.

Signed and Sealed this

Fifth Day of July, 1994

Bruce Lehman

*Attest:*

BRUCE LEHMAN

*Attesting Officer*

*Commissioner of Patents and Trademarks*